United States Patent [19]

Dubreuil

[11] 4,452,451

[45] Jun. 5, 1984

[54] HOCKEY STICK BLADE SAFETY PAD

[76] Inventor: J. Réal Dubreuil, 139 Cartier St., Sept-Iles, Canada, G4R 2T1

[21] Appl. No.: 416,943

[22] Filed: Sep. 13, 1982

[51] Int. Cl.[3] ..... A63B 59/14

[52] U.S. Cl. ..... 273/67 A

[58] Field of Search ..... 273/67 A, 67 D, 67 DA, 273/67 DB, 67 DC; 30/151, 286; 145/35 D; 150/52 R

[56] References Cited

FOREIGN PATENT DOCUMENTS

| | | | |
|---|---|---|---|
| 698375 | 11/1964 | Canada | 273/67 A |
| 850516 | 9/1970 | Canada | 273/67 A |
| 1008903 | 5/1957 | Fed. Rep. of Germany | 145/35 D |
| 492247 | 3/1954 | Italy | 145/35 D |

*Primary Examiner*—Richard C. Pinkham
*Assistant Examiner*—Matthew L. Schneider

[57] ABSTRACT

A hockey stick blade safety pad is disclosed. The pad is made of semi-rigid, semi-resilient material, being secured to the toe end of the blade and entirely covering the toe end from the top edge to the bottom edge. The pad has a pair of rearwardly-extending wings separated by a slot into which the front portion of the blade fits. The pad is of the same width as the blade. Various concave shapes on both the forehand and backhand sides of the blade can be obtained, ranging from straight to very curved.

4 Claims, 8 Drawing Figures

HOCKEY STICK BLADE SAFETY PAD

FIELD OF THE INVENTION

The present invention relates to the sport of ice-hockey and other similar less formal variations, more particularly to a hockey stick blade provided with a novel safety means to prevent injury.

BACKGROUND OF THE INVENTION

Anyone who is at all familiar with the sport of hockey, especially at the professional levels, can attest to the injuries which can, and do, occur. Non infrequently, injuries to the players are inflicted by the hockey sticks they use, when, for example, during a scramble for the puck, the sticks are raised a little too high. Although the sticks are not necessarily voluntarily raised, there is always the danger that the blade portion of a stick may strike a player in the facial area and so occasion a possibility of serious injury. Of course, the most dangerous part of the blade is the front or toe end. This is because players use a curved blade which has a relatively thin toe portion and the edge thereof is entirely unprotected.

A search of the prior art has revealed a recognition of the hazard of blade-inflicted injury. For example, Canadian Patent to De Meza (Nov. 24, 1964; No. 698,375) teaches the use of a "shield" adapted to cover the entire top edge of the blade. Such a shield is an improvement; however, the lower portion of the toe edge and the lower corner of the toe are left entirely unprotected. As in known, that part of the blade can also cause injury when, for example, a player falls or is already prone on the ice.

OBJECTS OF THE INVENTION

In view of the above, it is a prime object of the invention to provide a pad at the toe edge of the blade of a hockey stick which is made of resilient material and which entirely covers the toe edge.

It is another important object of this invention to provide a pad of the above type, which actually improves backhand shots.

It is yet another important object of this invention to provide a pad of the above type, which is simple in design and non-costly to produce and install.

SUMMARY OF THE INVENTION

The above and other objects and advantages of the present invention are realized according to a preferred embodiment comprising a pad made of semi-resilient material adapted to be rigidly secured to the toe end of a hockey stick blade. The material is resilient enough to absorb most of the force of an impact yet rigid enough so that the shooting characteristic of the blade is unimpaired.

The pad is of the same width as the front portion of the blade, having preferably a rounded front end projecting forwardly of the front edge of the blade. The pad is further formed with a pair of rearwardly-extending wings separated by a vertical slot. The latter is adapted to receive the front portion of the hockey stick blade. Preferably but not essentially, the pad wing on the backhand side of the blade has a surface which is shaped in such a way as to enhance the ability of a player to execute a backhand shot, as will be explained below.

Prior to the securing of the pad to the blade, two minor alterations are preferably made to the blade: firstly, the upper corner of the front edge of the blade is cut away angularly, thereby defining a substantially triangular recess between the top surface of the pad and the adjacent part of the blade. Thus, the former will be compressed inwardly under impact, thereby absorbing most of the force of the blow. Secondly, a front edge portion of the blade is removed so that when the pad is in place, the length of the blade will remain the same. However, it is to be understood that these alterations, especially the second, are not essential to the proper purpose of the pad. For instance, instead of removing the front portion of the blade, the latter may be manufactured in a shortened length.

The above will be more clearly understood by having referral to the preferred embodiment of the invention, illustrated by way of the accompanying drawings, in which:

BRIEF DESCRIPTION OF THE DRAWINGS

Like numerals refer to like elements throughout the drawings.

DETAILED DESCRIPTION OF THE PREFERRED EMBODIMENT

Figure 1:
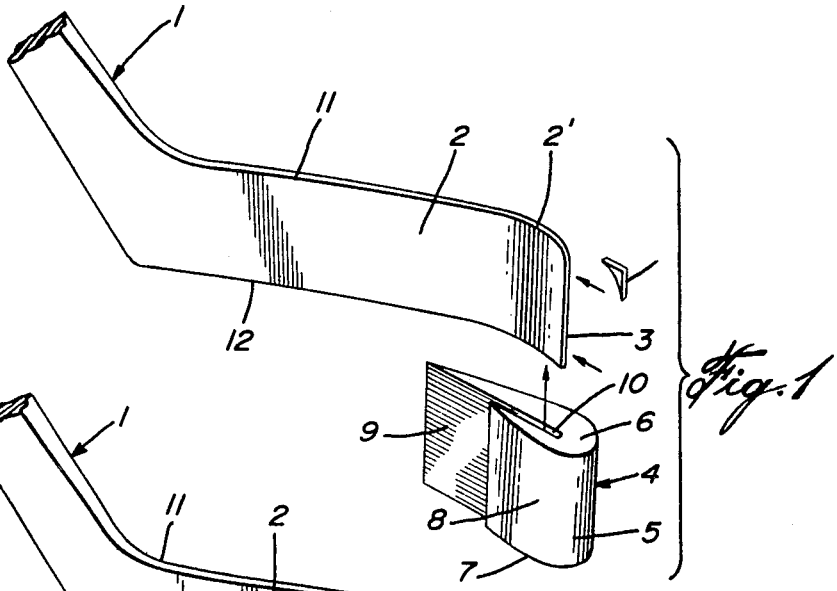
FIG. 1 is a perspective view of a hockey stick blade, also showing the pad ready to be installed.
Figure 2:
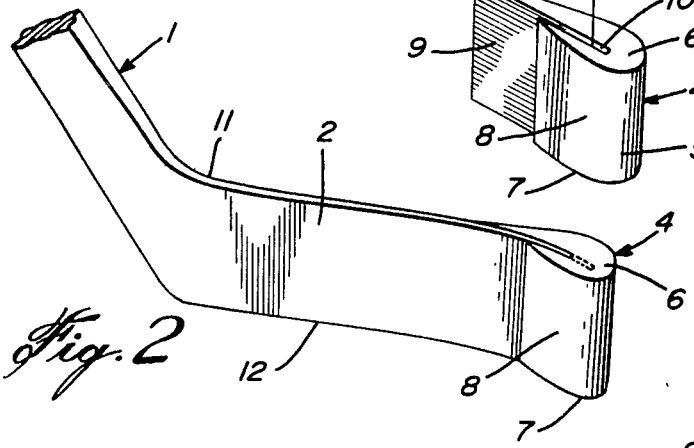
FIG. 2 is identical to the view of FIG. 1 but with the pad installed.

The present invention comprises a hockey stick 1 having a blade 2 which can be straight (FIG. 3) or curved for a left-handed player (FIGS. 5 and 6) or curved for a right-handed player (FIG. 7), in the known manner. Generally speaking, it is the front portion of the blade which is curved according to a player's individual preference.

Referring now to FIGS. 1 to 4, there is shown a blade 2 having opposite main faces a curved front end portion 2' and a straight toe edge 3 normal to the longitudinal axis of blade 2.

This toe edge 3 is adapted to be completely covered by a pad 4 which is made of semi-rigid, semi-resilient material, such as rubber, nylon or foam. Pad 4 has a front body portion 5 which is exteriorly rounded, flat upper and lower end surfaces 6 and 7 respectively and a pair of rearwardly-extending wings 8 and 9. The latter are separated by a longitudinal slot 10.

As clearly shown in the figures, pad 4 is rigidly secured, by glue or any other suitable bonding means, to the front portion of blade 2, entirely surrounding the same. Body portion 5 is thicker than the front portion 2' of blade 2 and wings 8 and 9 taper from body portion 5 towards their free ends to merge with the main faces of the blade 2.

Figure 4:
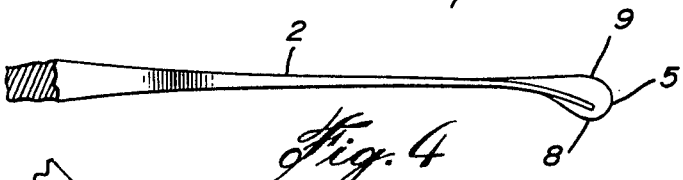
FIG. 4 is a top plan view of the blade of FIG. 2.
Figure 5:
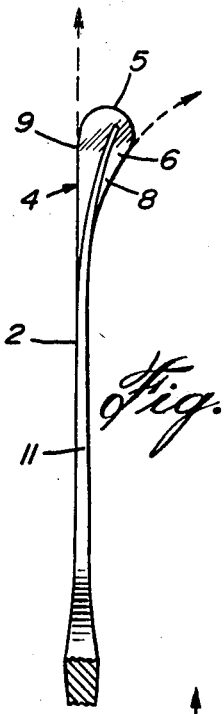
FIGS. 5 and 6 are top plan views of left-handed hockey stick blades provided with the pad, illustrating a straight backhand and pronounced forehand curve; and a curved backhand and less pronounced forehand curve, respectively.
Figure 7:
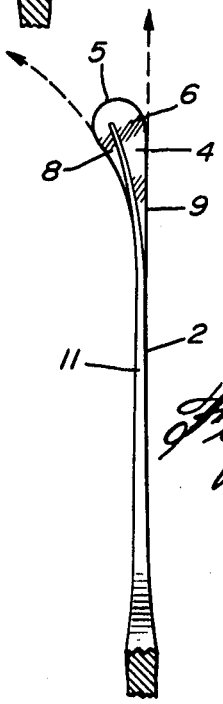
FIG. 7 is similar to the views of FIGS. 5 and 6, but depicting a right-handed hockey stick blade.
Figure 8:
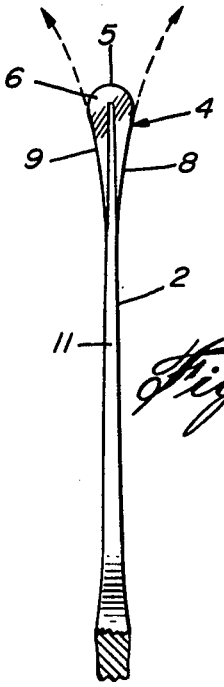
FIG. 8 is a top plan view of a straight blade provided with the pad.

Preferably the wing 9, i.e. the wing on the backhand side of the blade, is longer than the other wing 8. As shown in FIGS. 4, 5, and 7, wing 9 renders the backhand side of blade 2 substantially straight, thereby greatly improving the ability of a player to shoot from the backhand. Alternately, FIG. 8 depicts a curved backhand (concavely curved) which, it has been found, also improves backhand shooting. Thus, pad 4 provides an improved backhand according to a player's personal preference.

Preferably, the front toe edge 3 of the blade 2 is shortened to compensate for the increased length of a blade provided with pad 4. However, as mentioned above, the blade 2 itself could be produced in a preshortened length to meet the standards of professional hockey Rules Commissions.

Figure 3:
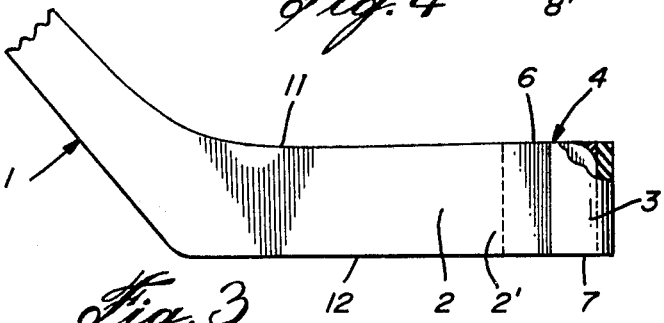
FIG. 3 is a side elevation of a hockey stick blade provided with the pad, the latter partially sectioned at its upper corner.

To further ensure protection from a hit by the upper corner 15 of blade 2, the former is angularly cut away, as seen in FIGS. 1 and 3, thereby forming a triangular cavity thereat. Thus, when a player receives a blow from that portion of the stick blade, pad 4 is compressed inwardly at the cavity to effectively cushion the blow.

It will be noted that the distance between end surfaces 6 and 7, that is the length of pad 4 is the same as the width as blade 2, such that surfaces 6 and 7 are flush with the top and bottom edges 11 and 12 of blade 2, respectively.

Figure 6:
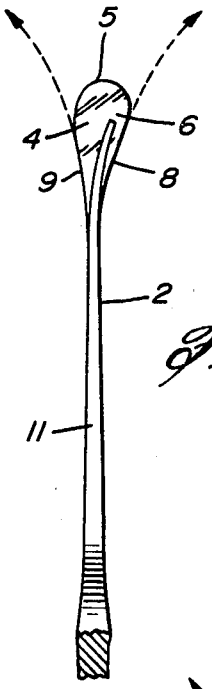

It will also be noted that the same pad 4 can be used for either a right-handed or left-handed hockey stick, as needed by simply flipping it upside down; and that pad 4 may be of varying thickness according to the degree of curvature desired, as suggested by FIGS. 5 and 6.

It has also been found that a blade 2, provided with pad 4, is very efficient for freeing a puck frozen against the boards of an arena by an adversary, i.e. for "digging" the puck out. This is accomplished by the relatively large flat surfaces 6 and 7.

Although the above advantages are within the scope of the invention, the prime purpose is to pevent injury by blade 2; the relatively safe and extensive surfaces of pad 4 serve to safely absorb blows.

Other advantages within the scope of the invention are: improved forehand shots and improved face-off control; adaptability for variations of ice-hockey, such as "soft shoe hockey", which is played on a surface other than ice and without skates. For such variations, it is envisioned to provide a slightly harder material for pad 4, because the puck used in such sport is softer.

What I claim is:

1. The combination of a hockey stick and a safety pad, said stick including an elongated blade having opposite main faces, a front toe edge substantially normal to the longitudinal axis of said blade and upper and lower edges, said upper and lower edges defining between themselves, a width of said blade, said pad being made of semi-rigid, semi-resilient material, having a front body portion and a pair of rearwardly extending wings separated by a longitudinal slot, said pad having a flat upper end surface and a flat lower end surface, said slot receiving the front toe edge and the front portion of said blade, said pad being adhered to said front portion of said blade and having a length equal to the width of said blade with said flat upper and lower end surfaces flush with the upper and lower edges respectively of said blade, the front toe edge of said blade being entirely covered by said pad.

2. The combination defined in claim 1, wherein said pad is thicker than the front portion of said blade, has a rounded front surface and said wings taper toward their free ends to merge with the main faces of said blade.

3. The combination as defined in claim 2, wherein one of said wings is longer than the other said wing.

4. The combination as defined in claim 2, wherein the upper front corner of said blade is angularly cut away, thereby defining a generally triangular recess between said pad and the adjacent part of said blade.

* * * * *